United States Patent [19]

Boutin et al.

[11] 4,441,933

[45] Apr. 10, 1984

[54] METHOD OF MAKING PRODUCTS OF ALUMINIUM ALLOY SUITABLE FOR DRAWING

[75] Inventors: Francois-Regis Boutin, Virieu; Jan Kubie, Voiron, both of France

[73] Assignee: Scal Societe de Conditionnements en Aluminium, Paris, France

[21] Appl. No.: 469,757

[22] Filed: Feb. 25, 1983

[30] Foreign Application Priority Data

Apr. 30, 1982 [FR] France ..... 82 07924

[51] Int. Cl.[3] ..... C22F 1/04

[52] U.S. Cl. ..... 148/2; 148/11.5 A; 148/31.5

[58] Field of Search ..... 148/11.5 A, 31.5, 2

[56] References Cited

U.S. PATENT DOCUMENTS

| | | | |
|---|---|---|---|
| 4,039,356 | 8/1977 | Schumacher et al. | 148/31.5 |
| 4,111,721 | 9/1978 | Hitchler et al. | 148/11.5 A |
| 4,163,665 | 8/1979 | Pearson | 148/11.5 A |
| 4,235,646 | 11/1980 | Neufeld et al. | 148/11.5 A |
| 4,269,632 | 5/1981 | Robertson et al. | 148/11.5 A |
| 4,318,755 | 3/1982 | Jeffrey et al. | 148/11.5 A |

FOREIGN PATENT DOCUMENTS 1198006 12/1979 France .

*Primary Examiner*—Peter K. Skiff

*Attorney, Agent, or Firm*—Oblon, Fisher, Spivak, McClelland & Maier

[57] ABSTRACT

The invention relates to a method of making sheets of aluminium suitable for drawing.

The method according to the invention comprises subjecting the product issuing from a continuous casting machine to a mechanical cleaning treatment and then to a controlled heat treatment in air at elevated temperature.

The method according to the invention is applicable in every case where aluminium products, such as strips etc. are subjected to drawing or reducing operations and in cases where it is desired to eliminate galling phenomena and to guarantee aesthetic qualities. The method according to the invention is used in particular in the manufacture of cans from blanks obtained by casting between cylinders.

3 Claims, No Drawings

METHOD OF MAKING PRODUCTS OF ALUMINIUM ALLOY SUITABLE FOR DRAWING

This invention relates to a method of making products of aluminium alloy suitable for drawing. The method according to the invention is applicable in particular to the strips obtained by casting between rolls.

It is known that strips of aluminium or aluminium alloy can be made by introducing this metal in molten form between the two rotating, cooled rolls of a casting machine in such a way that the liquid solidifies in the form of a strip up to about 2 meters wide and between 5 and 10 mm thick.

One such method is described in French Pat. No. 1,198,006.

Strips of this type have proved to be particularly suitable for the manufacture by deep drawing and ironing of cans intended in particular for the packaging of beverages. To this end, the strip is reduced to a thickness of around 300 μm by cold or hot rolling in several passes which may be separated by intermediate annealing treatments, after which circular discs are cut out from the sheet thus obtained and subjected to the combined action of a punch and die which results in the formation through deep drawing of a cup of which the walls surround the plunger. This cup is then subjected to dimensional transformation in an operation known as ironing during which its walls are reduced in thickness.

This shaping process requires the application of considerable forces to the surface of the metal, resulting fairly frequently in the appearance of a phenomenon known as "galling", i.e. seizing between the deep-drawn material and the deep-drawing tools. In the case of aluminium alloys, galling results in aluminium pick up on the tools used, leading progressively to the appearance of scores which, in some cases, are capable of reducing the mechanical strength of the cans and, sometimes, even of causing breaking during the ironing operation and, in any event, spoil the appearance of the cans.

It has also been found that the wall of a can can show irregularities either in its coloration or in the brightness of its surface.

Numerous studies have been conducted with a view to avoiding these surface irregularities and to providing the cans with an appearance that is satisfactory to the user. For example, detailed investigations have been made on the one hand into the equipment used and, more precisely, into the influence exerted by the nature of the materials used to make the tooling, the shape of the punch and the die, their dimensions and acceptable tolerances, the deep drawing rate, the lubrication conditions and, on the other hand, into the treated metal and, more particularly, into its composition, its structure, its mechanical characteristics and the condition of its surface.

It was as a result of these investigations that inventions were made, culminating in the grant of patents each proposing a solution to this problem of surface appearance.

The following patents have been granted in particular in the field of aluminum sheet produced by casting between rolls and intended for the manufacture of cans:

U.S. Pat. No. 3,930,895 which deals with the problems of galling when the alloy used is of the 3004 type according to the standard of the American Aluminium Association, i.e. having the following composition: Si 0.3%, Fe 0.5%, Cu 0.25%, Mn 1 to 1.5%, Mg 0.8 to 1.3%, Zn 0.25%, remainder Al. This U.S. Patent attributes the difficulties encountered to the fact that continuous casting between cylinders results in the formation of particles of Al-Mn less than 2 μm in size which are too small to have a cleaning effect on the tooling and, accordingly, contribute to the aluminium pick up thereof and, mentions the fact that, when an alloy of the type in question obtained by conventional casting is treated, the particles of Al-Mn are between 15 and 20 μm in size and do not cause any aluminium pick up. Nevertheless, seeking to utilize the advantages of continuous casting between rolls, particularly in regard to the uniformity of the microstructure, the inventor proposes modifying the composition of the type 3004 alloy by increasing its manganese content to between 2 and 3% in order to increase the size of the particles in question. Thus, in this U.S. Patent, the phenomenon of galling is associated with the microstructure of the deep-drawn metal.

U.S. Pat. No. 4,111,721 also reports this phenomenon of galling on sheets of 3004 and 3003 and likewise mentions the need to increase the size of the particles of Al-Mn and Al-Mn-Fe in order to eliminate it. However, to achieve that result, this US-PS does not seek to alter the composition of the alloy, but instead recommends a heat treatment which is preferably carried out at a temperature of 620° C. over a period of from 16 to 24 hours and which may be applied to the strip either immediately after casting or after it has been subjected to a first series of rolling passes.

Although processes such as these have reduced the phenomenon of galling, they have not brought about the complete disappearance of this phenomenon or of the irregularities in the coloration and surface brightness of the cans.

After numerous tests, Applicants have arrived at the conclusion that these faults were related to the surface condition of the freshly cast strip. Indeed, having subjected the strip to mechanical cleaning, they found that all the irregularities in coloration and brightness commonly encountered had disappeared. Unfortunately, there was a correlative increase in the phenomenon of galling so that, although the can no longer showed any differences in coloration or brightness, its appearance was now spoiled by the presence of scores.

Seeking to study the mechanism behind this process in detail, Applicants finally realized that the phenomenon of galling was thus associated with the surface condition of the strip and that it was necessary to have a coating on the aluminium to prevent aluminium pick up of the deep-drawing tools, in other words it was necessary in the final analysis to reform that part of the layer of product which had been removed during the mechanical cleaning process in such a way that by controlling its formation the irregularities in coloration and brightness are avoided. After numerous tests, Applicants found this layer could be formed by subjecting the strip to clearly defined conditions of temperature and atmosphere.

Thus, Applicants found that the freshly cast strip had to be heated in air to a temperature of from 520° to 550° C. over a period of a few hours in order to obtain anti-galling properties.

Thus, without resorting either to prolonged heat treatments at high temperatures or to alloys charged with manganese, Applicants succeeded in solving the problems in galling and irregularities in coloration and brightness by using a standard 3004 alloy and subjecting it to heat treatment under the usual conditions.

Accordingly, the present invention relates to a method of making sheets of aluminium alloy suitable for drawing, in which the alloy is cast between rolls to form a strip which is heat-treated and rolled to a thickness of around 300 μm in a series of passes optionally separated by annealing treatments in order to form a sheet from which are cut discs which are subjected to deep drawing and ironing, characterized in that the surface of the strip is mechanically cleaned and then modified by heating in air.

Thus, the new means used comprise first subjecting the strip to preferably continuous, mechanical cleaning. This mechanical cleaning operation may be carried out by means of any known device enabling most of the particles deposited on the surface of the strip and the thick oxide layer formed during casting to be eliminated whilst at the same time keeping the thickness of metal removed to a minimum. It may be carried out continuously, preferably by brushing by means of a rotating brush having metal or composite bristles (for example nylon plus tungsten carbide). The brushing treatment may be carried out in the direction of travel of the strip by means of a fixed cylindrical brush of which the length is slightly greater than the width of the strip and of which the axis is perpendicular to that direction.

However, it is also possible to use a short, cylindrical brush with one axis parallel to the direction of travel of the strip subjected to a traversing movement so that it regularly cleans the entire width of the strip with a certain overlap during each crossing. The rotational speeds of the brushes are adjusted in such a way as to expose the surface of the aluminium. A brushing treatment such as this may be carried out directly at the output end of the casting machine because the temperature of the metal is already sufficiently low ($T \leqq 400°$ C.) to enable it to be brushed without adhering metal to the bristles of the brush.

Instead of brushing, it is also possible to use a jet of gas under pressure emitted by a mobile source for cleaning the surface.

The cleaning operation may also be carried out on the strip after it has been subjected to one rolling pass when its thickness is of the order of 2.7 mm.

The cleaning operation may be carried out on one or both faces, depending on the purpose envisaged for the product. In the case of products for canning, it is only necessary to clean that face which will form the outside of the can.

After this treatment, an "anti-galling" layer is reformed on the surface of the strip by a heat treatment carried out at elevated temperature in air. This heat treatment is carried out by heating the roll formed by the strip cleaned and rolled up on leaving the casting machine for 4 to 8 hours in air to a temperature in the range from 520° to 550° C. A strip heated to a lower temperature or for a shorter duration is just as sensitive to galling during ironing as a freshly cleaned strip. Although, on the other hand, the results obtained by heating to a temperature above 560° C. are excellent from the point of view of galling, a brown layer is formed on the strip in that case and, in the products subjected to deep drawing and ironing produces surface irregularities, such as a more or less bright and more or less brownish appearance of which the unattractive effect results in rejection of the can thus obtained.

Modification of the surface of the strip by heat treatment may also be carried out continuously at the output end of the casting machine after the brushing treatment. Since, under these conditions, the heating time is necessarily short (of the order of 1 to 10 minutes) to eliminate prolonged residence times in the furnaces, the treatment temperatures should be higher—in the range from 600° to 620° C.—to obtain suitable modification of the surface. This treatment is preferably carried out in an electrical furnace although it may also be carried out in a flame furnace or in a controlled-atmosphere furnace.

The treatment is optimized according to the type of furnace, its more or less humid atmosphere and the composition of the alloy being treated, particularly in regard to its magnesium and manganese contents. This is because experience has shown that the higher the magnesium content, the shorter may be the treatment time and the lower the treatment temperature.

Accordingly, the method according to the invention is not confined solely to the alloy 3004 and the results obtained with the invention have been verified and confirmed with alloys richer in magnesium, which contained for example 0.8% of Mn and 2% of Mg, or less rich in magnesium, for example with an Mn content of 1.5% and an Mg content of 0.5%.

Clearly, this treatment in an oxidizing atmosphere may contribute for certain alloys to the homogenization effect required for improving the mechanical characteristics.

The strip coated with the layer formed by the heat treatment is then subjected to the rolling operations to convert it into sheets approximately 300 μm thick.

These rolling passes may be accompanied by intermediate and/or final annealing treatments without significantly affecting the condition of the layer.

The sheets finally obtained are eminently suitable for drawing, and show remarkable aesthetic qualities.

We claim:

1. A method of making sheets of aluminum alloy suitable for drawing comprising the steps of:

(a) casting the alloy between cylinders to form a strip;

(b) subjecting the strip to mechanical cleaning to enable most of the particles deposited on the surface and the thick oxide layer formed during casting to be eliminated;

(c) reforming an oxide anti-galling layer on the surface of the strip by heat treatment carried out at elevated temperature in air intermittently over a period of 4 to 8 hours at a temperature in the range of 520° to 550° C. or continuously over a period of 1 to 10 minutes at a temperature in the range of 600° to 620° C.;

(d) subjecting the strip coated with the layer to the rolling operations to convert it in a sheet with a thickness of the order of 300 μm in a series of passes optionally separated by annealing treatment;

(e) cutting discs from the sheet; and (f) subjecting discs to deep drawing and ironing.

2. A method as claimed in claim 1, characterized in that the mechanical cleaning treatment is carried out by means of brushes having metal or composite bristles.

3. The method of claim 1 wherein the strip formed in step (a) is subjected to a rolling pass to convert it into sheets of about 2.7 mm thickness prior to step (b).

* * * * *